United States Patent [19]

Thonnessen

[11] Patent Number: 4,913,355

[45] Date of Patent: Apr. 3, 1990

[54] ELECTROMAGNETIC INJECTION VALVE FOR INTERNAL COMBUSTION ENGINES

[75] Inventor: Dieter Thonnessen, Viersen, Fed. Rep. of Germany

[73] Assignee: Pierburg GmbH, Neuss, Fed. Rep. of Germany

[21] Appl. No.: 317,535

[22] Filed: Mar. 1, 1989

[30] Foreign Application Priority Data

Mar. 30, 1988 [DE] Fed. Rep. of Germany ..... 3810827

[51] Int. Cl.[4] ..... B05B 1/30

[52] U.S. Cl. ..... 239/585; 251/129.15

[58] Field of Search ..... 239/585; 251/129.15

[56] References Cited

U.S. PATENT DOCUMENTS

| | | | |
|---|---|---|---|
| 1,288,439 | 12/1918 | Pattinson | 239/585 |
| 3,702,683 | 11/1972 | Sturmer | 239/585 |
| 3,731,881 | 5/1973 | Dixon et al. | 239/585 |
| 4,643,359 | 2/1987 | Casey | 239/585 |
| 4,771,984 | 9/1988 | Szablewski et al. | 239/585 |

FOREIGN PATENT DOCUMENTS

| | | | |
|---|---|---|---|
| 2073954 | 10/1981 | United Kingdom | 239/585 |

*Primary Examiner*—Andres Kashnikow
*Assistant Examiner*—Michael J. Forman
*Attorney, Agent, or Firm*—Ladas & Parry

[57] ABSTRACT

An electromagnetic injection valve in which the spring acting between an iron core and a valve closure member is made of spring steel. The iron core is formed as a round rod which is reduced in diameter at the end thereof forming a stop surface for the valve closure member. A protruding support ring of nonmagnetic material is fixed to the valve closure member for the guidance of the spring, such that the turns of the spring are spaced from the surfaces of the reduced diameter end of the rod and the valve closure member in the region of the air gap between the rod and valve closure member by at least an amount equal to the reduction in diameter of the end of the rod.

5 Claims, 1 Drawing Sheet

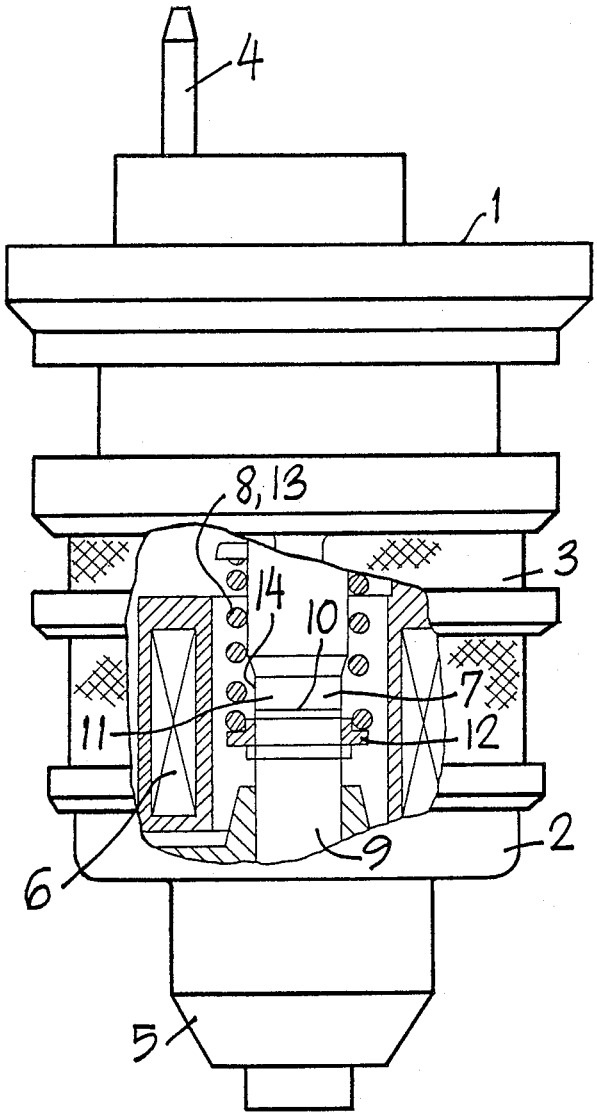
4
1
8,13
3
14
10
7
11
12
6
9
2
5

ELECTROMAGNETIC INJECTION VALVE FOR INTERNAL COMBUSTION ENGINES

FIELD OF THE INVENTION

The present invention relates to an electromagnetic injection valve for internal combustion engines.

BACKGROUND

Electromagnetic injection valves must withstand the rough operating conditions of the internal combustion engine in motor vehicles.

In particular, these injection valves are subject, on the one hand, to vibrating loads due to the periodic movements of the valve closure member back and forth and, in addition to this, to superimposed vibration from the engine. As a result, the spring which urges the valve closure member towards the valve seat frequently breaks.

The magnetic circuit of the injection valve is designed to produce a high flux density in the air gap through the valve closure member, acting as an armature, when the magnetic field is energized.

In order to maintain this flux density and the magnetic force produced thereby at a high value, the region in the vicinity of said air gap must be kept free of magnetizable materials, for which reason the springs, heretofore used thereat must be made of nonmagnetic material.

However, nonmagnetic material cannot withstand high loads as well as spring steel.

SUMMARY OF THE INVENTION

An object of the present invention is to provide an electromagnetic injection valve in which the biassing spring of the valve closure member can be made of spring steel without reducing the magnetic flux density in the air gap.

This is achieved in accordance with the invention by a construction of the electromagnetic injection valve comprising an iron rod mounted within a coil and axially facing a movable valve closure member aligned therewith, the spring engaging the rod and valve closure member such that the valve closure member is moved between open and closed position when the coil is actuated and de-actuated; the rod includes an end portion facing the valve closure member to form an air gap therewith, said end portion having a stop surface for said valve closure member in one of said positions. The iron rod is reduced in diameter in said end portion. A support ring of nonmagnetic material is secured to the valve closure member, and supports one end of the spring such that the spring extends in the region of the air gap with clearance past the valve closure member and the end portion of reduced diameter by an amount at least equal to the reduction in diameter of said end portion with respect to the remainder of the rod.

BRIEF DESCRIPTION OF THE DRAWING

The sole FIGURE of the drawing is an elevational view partly broken away showing a preferred embodiment according to the invention.

DETAILED DESCRIPTION OF A PREFERRED EMBODIMENT

In the drawing, there is shown an electromagnetic injection valve 1 for an internal combustion engine which comprises a housing 2, a filter section 3, an electrical connector 4, and a nozzle 5. In its interior, the valve 1 incorporates the structural elements necessary for its proper operation, including a coil 6, an iron core constituted as an iron rod 7 and a valve closure member 9 axially aligned with rod 7 and urged by the force of a spring 8 against a valve seat (not shown) in nozzle 5.

The valve operates in conventional manner in that valve closure member 9 moves between open and closed positions in response to actuation and deactivation of the coil 6, and in the open position filtered fuel is injected from nozzle 5. The rod 7 serves as a stop for the valve closure member 9 in the open position thereof. The valve is closed by deactuating coil 6 whereupon spring 8 displaces the valve closure member 9 against its valve seat. In the closed position an air gap 14 is formed between rod 7 and valve closure member 9.

In accordance with the invention, the round rod 7 is reduced in diameter at the end 11 thereof at which a stop surface 10 is provided for the valve closure member 9. The valve closure member 9 has a protruding suporting ring 12 of nonmagnetic material fixedly secured thereto. The spring 8 acts between round rod 7 and valve closure member 9 by bearing against support ring 12 on valve closure member 9 and an abutment collar fixed on rod 7. In the region of air gap 14, the turns 13 of the spring 8 are spaced from the surfaces of the reduced diameter portion 11 of rod 7 and the valve closure member 9 by an amount at least equal to the reduction in diameter of end 11 of rod 7. Beyond the reduced diameter portion 11, the spring 8 rides on the surface of the rod 7.

By these measures, the flux density or magnetic force is maintained in its entirety and the number of stray lines of force is not increased, despite the use of magnetizable materials for the spring 8.

The injection valve 1 of the invention is characterized by a long life and high magnetic force on the valve closure member 9. It can be used in rough vehicle operation.

While the invention has been described in relation to a specific embodiment thereof, it will become apparent to those skilled in the art that numerous modifications and variations can be made within the scope and spirit of the invention as defined in the attached claims.

What is claimed is:

1. An electromagnetic injection valve for an internal combustion engine comprising an electrical coil, an iron rod in said coil, a movable valve closure member axially aligned with said rod, a spring engaging said rod and said valve closure member such that the valve closure member is movable between open and closed positions when the coil is actuated and deactuated, said rod including an end portion facing said movable valve closure member to form an air gap therewith in one of said positions, said end portion having a stop surface for said valve closure member in the other of said positions, said iron rod being reduced in diameter in said end portion, a support ring of nonmagnetic material on said movable valve closure member, said spring having one end supported on said support ring and extending in the region of said air gap with clearance past said valve closure member and said end portion of reduced diameter by an amount at least equal to the reduction in diameter of said end portion with respect to the remainder of said rod, said spring extending on said iron rod beyond the reduced diameter portion thereof to ride on said rod outside said end of reduced diameter, said spring being made of magnetic material.

2. An electromagnetic injection valve as claimed in claim 1 wherein said magnetic material is spring steel.

3. An electromagnetic injection valve as claimed in claim 1 comprising an abutment collar on said iron rod, said spring having a second end bearing against said abutment collar.

4. An electromagnetic injection valve as claimed in claim 3 wherein said air gap is located within said coil.

5. An electromagnetic injection valve as claimed in claim 3 wherein said iron rod includes a conical portion forming said reduction in diameter.

* * * * *